US009790660B1

(12) United States Patent
Marquette et al.

(10) Patent No.: US 9,790,660 B1
(45) Date of Patent: Oct. 17, 2017

(54) CONTROL SYSTEM FOR A MACHINE

(71) Applicant: Caterpillar Inc., Peoria, IL (US)

(72) Inventors: Matthew Stephen Marquette, Peoria, IL (US); Jeffrey Kent Berry, Yorkville, IL (US); Brad Robert Van De Veer, Washington, IL (US); Thuong Dao Anh Le, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 23 days.

(21) Appl. No.: 15/077,008

(22) Filed: Mar. 22, 2016

(51) Int. Cl.

| | |
|---|---|
| ***E02F 3/42*** | (2006.01) |
| ***E02F 3/43*** | (2006.01) |
| ***E02F 9/20*** | (2006.01) |
| ***E02F 9/26*** | (2006.01) |
| *E02F 3/34* | (2006.01) |

(52) U.S. Cl.
CPC ..... *E02F 3/434* (2013.01); *E02F 3/431* (2013.01); *E02F 9/2004* (2013.01); *E02F 9/2041* (2013.01); *E02F 9/265* (2013.01); *E02F 3/34* (2013.01)

(58) Field of Classification Search
CPC . E02F 3/432; E02F 3/433; E02F 3/434; E02F 9/2235; E02F 9/2296; F15B 19/005; F15B 19/007; F15B 2211/50518; F15B 2211/6309; F15B 2211/633; F15B 2211/634; F15B 2211/6346; F15B 2211/6651; F15B 2211/6652; F15B 2211/6655; F15B 2211/6658; F15B 2211/857; F15B 2211/8643; F15B 2211/88; F01N 2900/08; F01N 2900/1622; F01N 3/208; F02D 2041/001; F02D 41/0002; F02D 41/0055; F02D 41/028; F03C 1/0678; F04B 1/26; F04B 2205/06; F04B 2205/09; F04B 23/06; F04B 49/065; F04B 49/08; F04B 49/22; Y02T 10/18; Y02T 10/24; Y02T 10/42; Y02T 10/47
See application file for complete search history.

(56) References Cited

U.S. PATENT DOCUMENTS

| | | | | |
|---|---|---|---|---|
| 3,487,958 A | | 1/1970 | Shook et al. | |
| 4,333,251 A | * | 6/1982 | Weisman | E02F 3/432 172/4.5 |
| 4,984,956 A | | 1/1991 | Ikari et al. | |
| 5,052,883 A | | 10/1991 | Morita et al. | |
| 5,359,516 A | | 10/1994 | Anderson | |
| 5,467,541 A | | 11/1995 | Greer et al. | |
| 5,727,387 A | | 3/1998 | Hosseini et al. | |

(Continued)

*Primary Examiner* — Jerrah Edwards
*Assistant Examiner* — Charles J Han

(57) ABSTRACT

A control system for a machine having a linkage, a work implement mounted on the linkage, and at least one actuator is provided. The actuator is connected to the linkage and controlled using the control system to move the linkage and the work implement. The control system includes sensors that are configured to sense a current load and position of the work implement. Upon sensing the current load and position of the work implement, a controller provided in the control system can reject or accept a given kick-out command issued from one or more user controls of the control system based on various criteria associated with the sensed load and position of the work implement.

8 Claims, 7 Drawing Sheets

(56) References Cited

U.S. PATENT DOCUMENTS

| | | | | |
|---|---|---|---|---|
| 6,000,563 | A * | 12/1999 | Greenberg | B66C 23/44 212/258 |
| 6,371,214 | B1 * | 4/2002 | Anwar | E02F 3/434 172/1 |
| 8,037,807 | B2 | 10/2011 | Callaghan et al. | |
| 8,965,637 | B2 | 2/2015 | Brooks et al. | |
| 8,977,441 | B2 | 3/2015 | Grimes et al. | |
| 2013/0004282 | A1 | 1/2013 | Grimes et al. | |
| 2013/0046447 | A1 | 2/2013 | Park | |
| 2015/0267719 | A1 | 9/2015 | Gorman et al. | |

* cited by examiner

CONTROL SYSTEM FOR A MACHINE

TECHNICAL FIELD

The present disclosure generally relates to a control system for a machine. More specifically, the present disclosure relates to a control system for selectively overriding accidental input commands that could cause the machine to inadvertently execute one or more operations.

BACKGROUND

It is known in the art to provide means whereby the operator of a machine such as a wheel loader may command a bucket of the wheel loader to move automatically and rapidly to a predefined position. Such a motion or command is referred to by the term "kick-out" because conventionally it has been implemented by moving a primary control, typically an operating lever or joystick, to an extreme position in which it is retained by a detent. The term "kick-out" reflects the action of the detent which automatically releases the joystick so that it kicks out of the extreme position and returns rapidly by resilient bias to the neutral position when the bucket reaches the predefined position (the "kick-out position"). A kick-out command allows the operator to move the bucket to a position in which it is ready for the next operation without having to provide a continuous input signal via the primary control, so making it easier to perform a series of repeated movements, for example, when scooping loose material from a pile and dumping it into a truck.

More recently, it has been known to provide separate kick-out controls such as momentary contact switches whereby the machine operator can issue a kick-out command without having to move the joystick or other operating levers to a kick-out position. U.S. Pat. No. 6,371,214 discloses a control system using which the kick-out command from the kick-out controls are selectively implemented depending on the position of the operating levers and on the previous movements of the machine. That indicates whether or not the operator has returned the operating levers to a position in which the bucket can be lowered, for example, after dumping the load into a truck. The term "kick-out" is still used for such controls and commands which cause the bucket to move to a predefined position, even where the detent action which gave rise to the term is no longer a feature of their operation.

However, as wheel loaders and like machines are typically operated in a rapidly changing and unpredictable environment, a user control may be operated accidentally or unintentionally.

SUMMARY OF THE DISCLOSURE

In one aspect of the present disclosure, a control system is provided for a machine having a linkage, and a work implement mounted on the linkage. The machine also includes at least one actuator connected to the linkage and controlled by the control system to move the linkage and the work implement. The control system includes a plurality of sensors that are configured to generate load data indicative of a sensed load of the work implement and position data indicative of a sensed position of the work implement. The control system further includes user controls for sending user commands and at least one kick-out command therefrom. The user controls include at least one primary control that is configured to send at least the user commands.

The control system also includes a controller that is communicably coupled to the sensors and the user controls. The controller is configured to receive the user commands and the kick-out command from the user controls; receive the load data and the position data from the plurality of sensors; move the work implement to a position defined by the user command from the primary control in response to receiving a user command from the primary control; move the work implement to a predefined kick-out position in response to the kick-out command from the user controls. Moreover, the controller is also configured to determine a work implement load state based on the load data, and accept or reject the kick-out command based on at least the work implement load state.

In another aspect of the present disclosure, a machine includes a linkage, a bucket mounted on the linkage, at least one actuator connected to the linkage; and the control system of the present disclosure for controlling the actuator to move the linkage and the bucket.

In yet another aspect of the present disclosure, a method is provided for controlling a machine having a controller, a work implement mounted on a linkage, at least one actuator connected to the linkage and operable by the controller to move the work implement, a plurality of sensors, and user controls for sending user commands and at least one kick-out command to the controller, the user controls including at least one primary control for sending at least the user commands, the controller being communicably coupled to the sensors and to the user controls. The method includes sending, to the controller from the plurality of sensors, load data indicative of a sensed load of the work implement and position data indicative of a sensed position of the work implement.

The method further includes sending, from the primary control to the controller, a user command; and responsive to the user command from the primary control, operating, by the controller, the actuator to move the work implement to a position defined by the user command from the primary control. The method also includes sending, from the user controls to the controller, a kick-out command.

The method also includes determining, by the controller based on the load data, a work implement load state; and accepting or rejecting, by the controller based on at least the work implement load state, the kick-out command from the user controls. The method further includes operating, by the controller, the actuator to move the work implement to a predefined kick-out position in response to accepting, by the controller, the kick-out command from the user controls.

Other features and aspects of this disclosure will be apparent from the following description and the accompanying drawings.

BRIEF DESCRIPTION OF THE DRAWINGS

The features and advantages of the present disclosure will become more apparent from the detailed description set forth below when taken in conjunction with the drawings, in which like reference numbers indicate identical or functionally similar elements. Additionally, the left-most digit of a reference number identifies the drawing in which the reference number first appears.

DETAILED DESCRIPTION

The detailed description of exemplary embodiments of the disclosure herein makes reference to the accompanying drawings and figures, which show the exemplary embodiments by way of illustration only. While these exemplary embodiments are described in sufficient detail to enable those skilled in the art to practice the disclosure, it should be understood that other embodiments may be realized and that logical and mechanical changes may be made without departing from the spirit and scope of the disclosure. It will be apparent to a person skilled in the pertinent art that this disclosure can also be employed in a variety of other applications. Thus, the detailed description herein is presented for purposes of illustration only and not of limitation.

Figure 1:
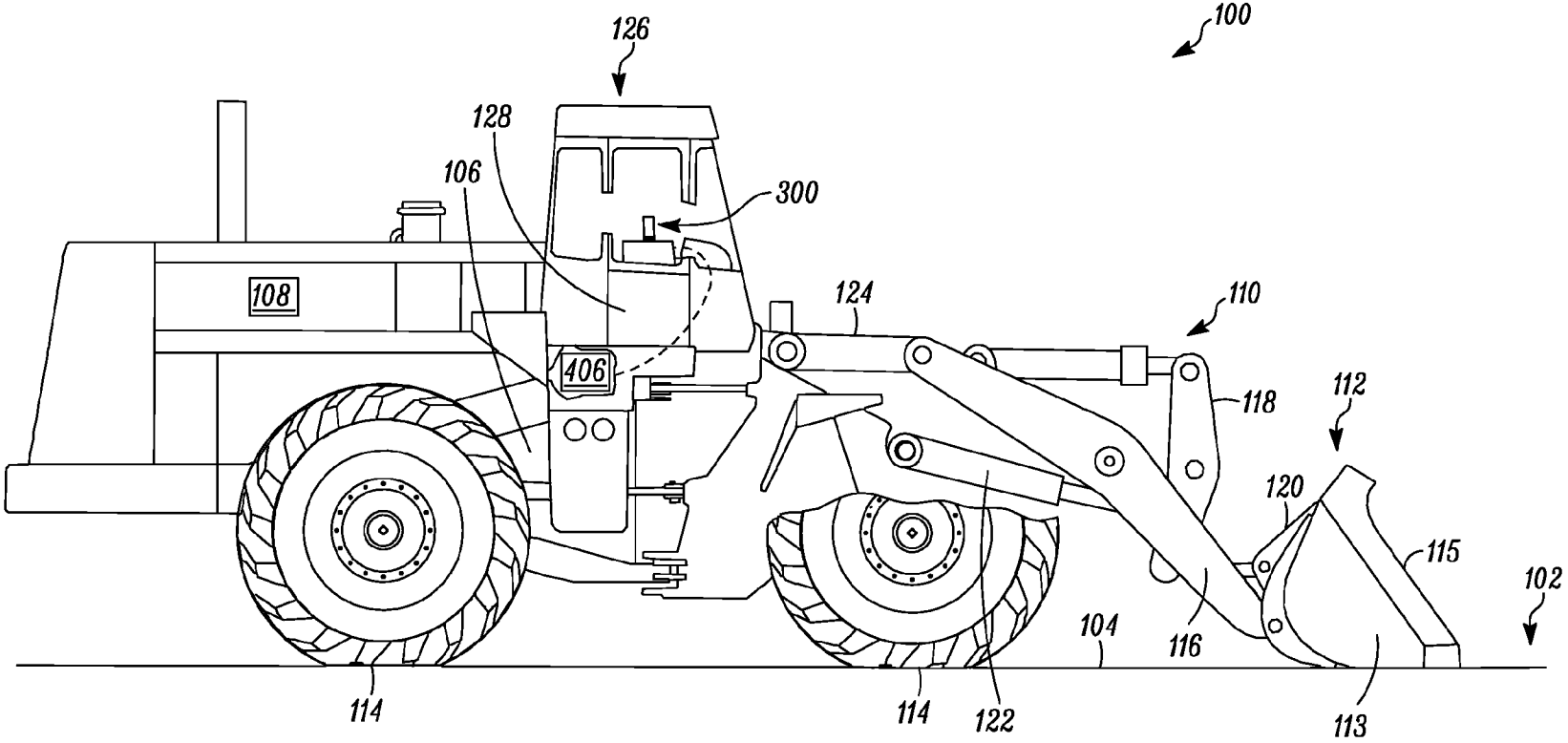
FIG. 1 is a side view of an exemplary machine having a work implement in accordance with embodiments of the present disclosure.

With reference to FIG. 1, an exemplary machine 100 is depicted. As shown in FIG. 1, the machine 100 comprises a Wheel Loader (WL), which is located on a job site 102. The machine 100 may be used in a variety of applications including mining, quarrying, road construction, construction site preparation, etc. For example, the WL shown in FIG. 1 may be employed for hauling earth materials such as ore, soil, debris, or other naturally occurring deposits from the job site 102; and for dumping such earth materials at a designated location e.g., within a container of a truck, or at another designated location on the job site 102.

Although the exemplary machine 100 is embodied as a WL in the illustrated embodiment of FIG. 1, other types of machines including, but not limited to, shovels, diggers, hydraulic excavators, and the like can be optionally used in lieu of the WL to implement the embodiments of the present disclosure. Therefore, it may be noted that the embodiments of the present disclosure can be similarly applied to other types of machines without deviating from the spirit of the present disclosure. Moreover, for purposes of the present disclosure, the machine 100 may be regarded as a manually-operated machine having automated functions operably executable via user controls 300 and a controller 406 provided therein (also shown in FIGS. 5-6).

Referring to FIG. 1, the machine 100 may include a frame 106 configured for supporting a cab 126, a drive system 108, a linkage 110, a work implement 112, and multiple ground engaging members e.g., wheels 114. The cab 126 may include a door 128 that is configured to allow access to an operator for entering and exiting the cab 126. As such, the cab 126 could be sized and shaped to house an operator of the machine 100.

The work implement 112 may be any implement for carrying and releasing a load. In embodiments, the work implement 112 may be configured to carry and dump a load of loose material, in which case it may include a moveable blade, jaws, or other features as required to scoop, dump and otherwise manipulate the loose material. In yet further embodiments, the work implement 112 may be configured to handle a specialized load, for example, as a fork or grapple arrangement for handling logs or other large objects.

In the illustrated embodiment, the work implement 112 is configured as a bucket, which has fixed walls 113 and one open side 115 through which a load of loose material can be introduced into the bucket. The work implement 112 is pivotable to define an angular position of the work implement 112 in a range of movement between an upwardly open position and a downwardly open position e.g., when the bucket is dumping out the scooped material; wherein the position of the open side 115 is taken to define the position of the work implement 112 as upwardly, downwardly, or forwardly open. An example of the forwardly open position of the work implement 112 may include, when the open side 115 of the work implement 112 is tilted away from the linkage 110 so as to be in a ready-to-get position relative to a pile of material The drive system 108 may include an engine (not shown), an electric motor e.g., a traction motor (not shown), or both depending on specific requirements of an application. The drive system 108 is configured to produce and transmit output power to the wheels 114 and the linkage 110 so as to perform certain desired functions using the work implement 112 of the machine 100. The desired functions can be, for example, digging, dumping, hauling, etc. Referring to FIG. 1, only one side of the machine 100 is illustrated and hence, only two wheels 114 are visible. However, it should be noted that a similar pair of wheels (not shown) are present on the other side of the machine 100 as well.

In an embodiment as shown in FIG. 1, the linkage 110 may include a lift arm 116 that is pivotally coupled to the frame 106 of the machine 100. The linkage 110 also includes an actuator i.e., a hydraulic cylinder 122 pivotally coupled to the frame 106 and the lift arm 116. Movement of the lift arm 116 can be actuated using the hydraulic cylinder 122 for lowering or raising the work implement 112 relative to the frame 106. The linkage 110 also includes a lever link 118, a work implement link 120, and another actuator, such as a hydraulic cylinder 124, as shown in FIG. 1. One end of the hydraulic cylinder 124 may be pivotally coupled to the frame 106 while another end of the hydraulic cylinder 124 may be pivotally coupled to the lever link 118. Likewise, the lever link 118 may be pivotally coupled to the work implement link 120 remote from where the hydraulic cylinder 124 is coupled to the lever link 118. Moreover, the work implement link 120 may be rigidly connected to the work implement 112 remote from where the lever link 118 is pivotally coupled to the hydraulic cylinder 124.

As the linkage 110 is operatively driven by the drive system 108, the linkage 110, upon receipt of appropriate commands from the user controls 300, can initiate a movement of the work implement 112 relative to the frame 106 of the machine 100 during operation. Accordingly, the work implement 112 can perform functions such as, but not limited to, digging, dumping, hauling, or handling material relative to a work surface 104 of the job site 102. Specifically, with appropriate commands from the user controls 300 to the hydraulic cylinder 122, the lift arm 116 can be moved relative to the frame 106 for lowering or raising a position of the work implement 112 relative to the work surface 104 of the job site 102. Likewise, with appropriate commands from the user controls 300 to the hydraulic cylinder 124, the lever link 118 and the work implement link 120 can be moved relative to the lift arm 116 for tilting the work implement 112 upwardly or downwardly relative to the lift arm 116. Therefore, the user controls 300 may be operated for maneuvering the linkage 110 and subsequently positioning the work implement 112 in a range of discrete positions within a range of movement of the work implement 112 for performing functions consistent with the present disclosure. In embodiments of the present disclosure, it is contemplated that the user controls 300 may be advantageously configured to receive user inputs from an operator for issuing at least one of two types of commands—user commands and kick-out commands. The user commands may include any continuous user inputs using the user controls 300 so that the operator may manually implement a control in the movement of the work implement 112 to any discrete position within the range of movement of the work implement 112. It is hereby contemplated that a direction and speed of movement of the work implement 112 may also be determined from the type of user input issued through the user controls 300.

The kick-out command may include any user input from the user controls 300 with which the operator may command the work implement 112 to move to a pre-defined position (a "kick-out position") within the range of movement of the work implement 112. The user controls 300 may be configured with such kick-out commands so as to move the work implement 112 to corresponding pre-defined kick-out positions. Therefore, for the purposes of the present disclosure, it may be noted that the user commands and the kick-out commands are mutually exclusive of each other.

Figure 6:
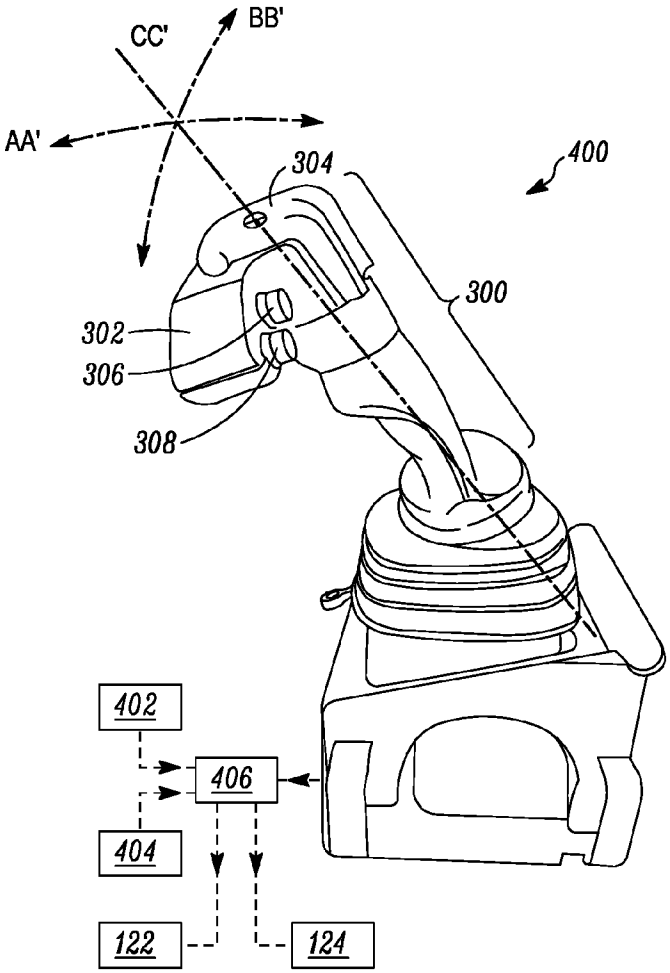
FIG. 6 is a side perspective view of user controls from FIG. 5 in accordance with embodiments of the present disclosure.
Figure 5:
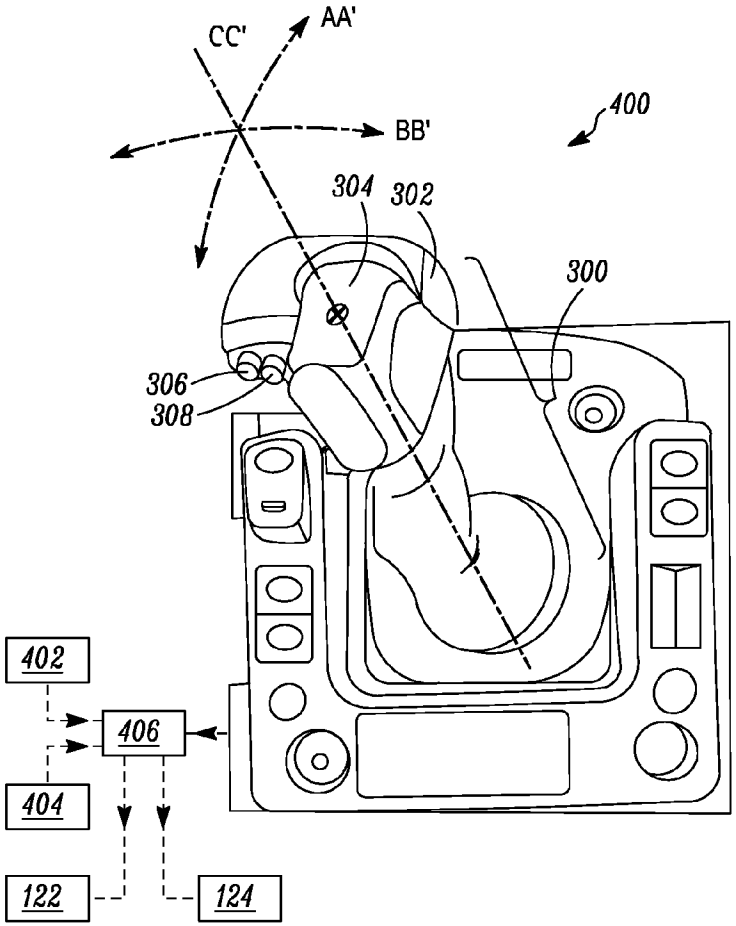
FIG. 5 is a top perspective view of user controls that can be used to control an operation of the work implement in accordance with embodiments of the present disclosure.

Referring to FIGS. 5-6, the user controls 300 includes at least one primary control 302. The primary control 302 may include one or more levers, a joystick, or any other control or controls that can receive user input.

Movement of the primary control 302 may determine both the direction and the speed of movement of the work implement 112. For example, a speed of movement of the work implement 112 may be proportional to the degree of displacement of the primary control 302 from its neutral position CC'. Moreover, as shown in FIGS. 5-6, the primary control 302 may have one axis of movement to control one function of the machine 100 or more than one axis of movement to control more than one functions of the machine 100. In the illustrated example, the primary control 302 has two axes of movement AA' and BB' respectively, each of which may be provided to control different ones of the hydraulic cylinders 122, 124 and accomplish different movements of the work implement 112. In various embodiments of the present disclosure, it may also be noted that the primary control 302 is also resiliently biased to the neutral position CC', wherein such neutral position CC' beneficially corresponds with an intersection of axes AA' and BB' as shown in FIGS. 5-6.

In an embodiment of this disclosure, the primary control 302 can be moved to discrete positions along each of the axes AA' and BB' for issuing various user commands. For example, the primary control 302 may be moved forwardly along axis AA' i.e., forward of axis CC' for causing the hydraulic cylinder 122 to lower the work implement 112 relative to the frame 106. Similarly, the primary control 302 may be moved rearwardly along axis AA' i.e., rearward of axis CC' causing the hydraulic cylinder 122 to raise the work implement 112 relative to the frame 106. Further, the primary control 302 can be tilted leftward along axis BB' i.e., leftward of axis CC' for commanding the hydraulic cylinder 124 to cause an upward tilting or racking of the work implement 112 relative to the lift arm 116. Similarly, the primary control 302 can be tilted rightward along axis BB' i.e., rightward of axis CC' for commanding the hydraulic cylinder 124 to cause a downward tilting of the work implement 112 relative to the lift arm 116.

Additionally, the primary control 302 can be moved to pre-defined positions about axis CC' for issuing various kick-out commands. Some examples of kick-out commands may include, but is not limited to, a raise kick-out command in response to which the work implement 112 may be raised to a pre-defined raise kick-out position relative to the frame 106 as shown in FIG. 2, a lower kick-out command in response to which the work implement 112 may be lowered to a pre-defined lower kick-out position relative to the frame 106 as shown in FIG. 4, a dump kick-out command in response to which the work implement 112 is tilted downwardly to a pre-defined dump kick-out position relative to the lift arm 116 as shown in FIG. 3, a rack-back kick-out command in response to which the work implement 112 is tilted upwardly to a pre-defined rack-back position relative to the lift arm 116 as shown in FIG. 2, and a ready-to-dig kick-out command in response to which the work implement 112 is tilted to a pre-defined forwardly-open position relative to the lift arm 116 as shown in FIG. 4.

It may be noted that the ready-to-dig kick-out command could cause a tilting-up or a tilting down of the work implement 112 depending on a current angular position of the work implement 112 relative to the lift arm 116. In an example, if the work implement 112 is currently disposed in an upwardly facing position, issuance of a ready-to-dig kick-out command can cause a downward tilting of the work implement 112 to the ready-to-dig kick-out position e.g., the pre-defined ready-to-dig kick-out position shown in FIG. 4. On the contrary, if the work implement 112 is currently disposed in a downwardly facing position, issuance of a ready-to-dig kick-out command can cause an upward tilting (racking) of the work implement 112 to the ready-to-dig kick-out position e.g., the pre-defined ready-to-dig kick-out position shown in FIG. 4.

Figure 2:
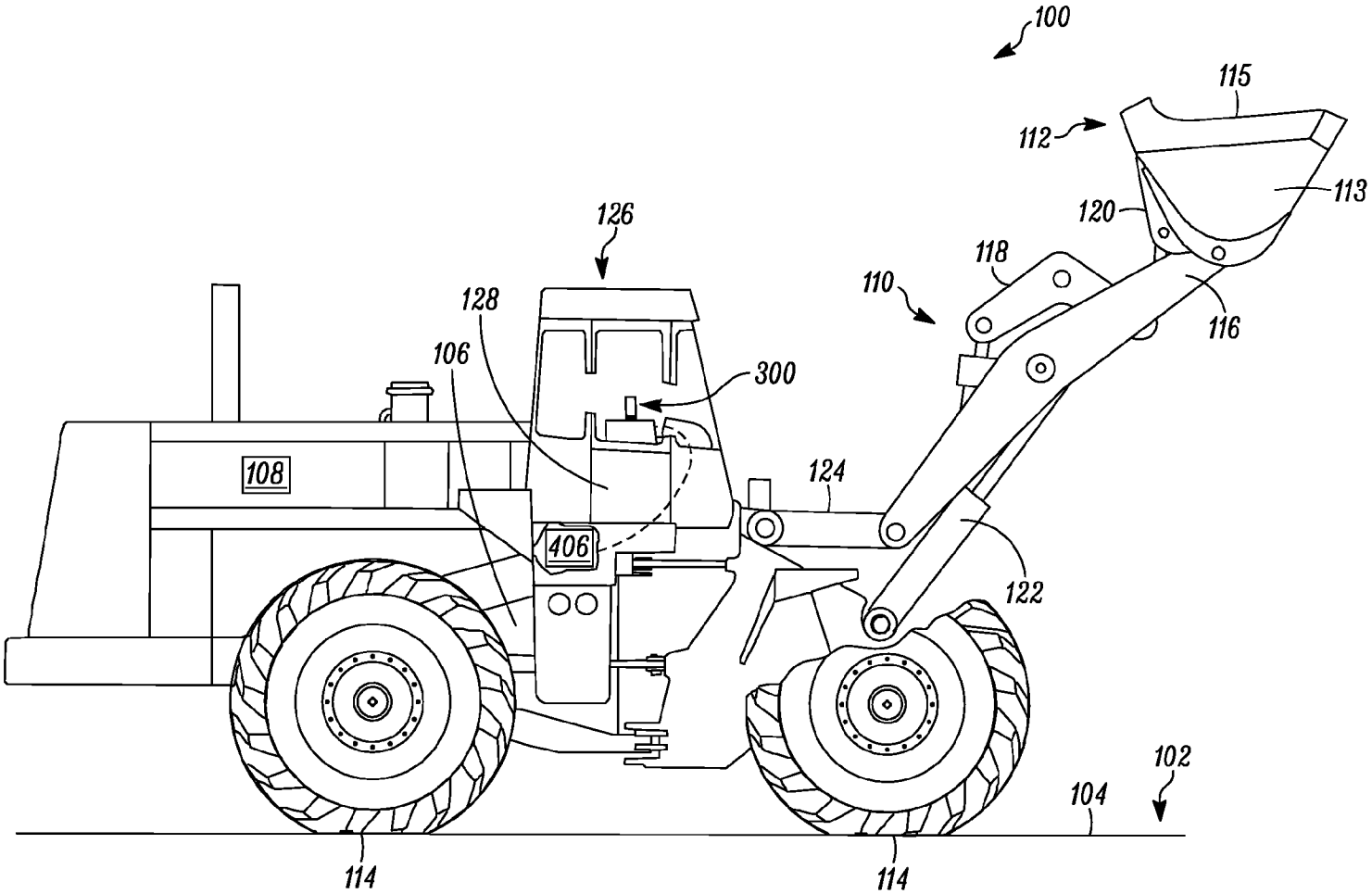
FIG. 2 is the exemplary machine of FIG. 1, showing a raised and upwardly tilted position of the work implement, in accordance with an embodiment of the present disclosure.
Figure 3:
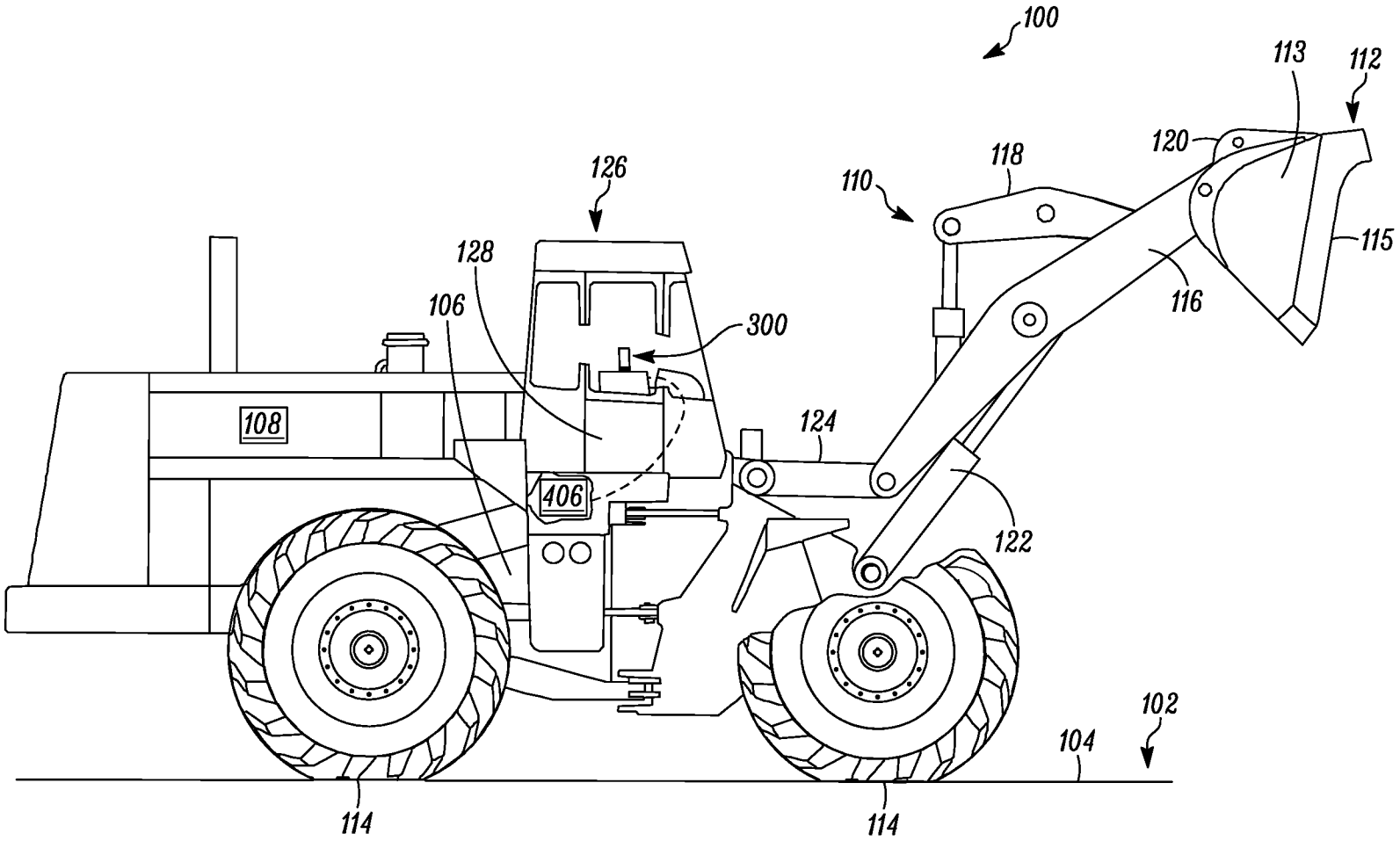
FIG. 3 is the exemplary machine of FIG. 1, showing a raised and downwardly tilted position of the work implement, in accordance with an embodiment of the present disclosure.
Figure 4:
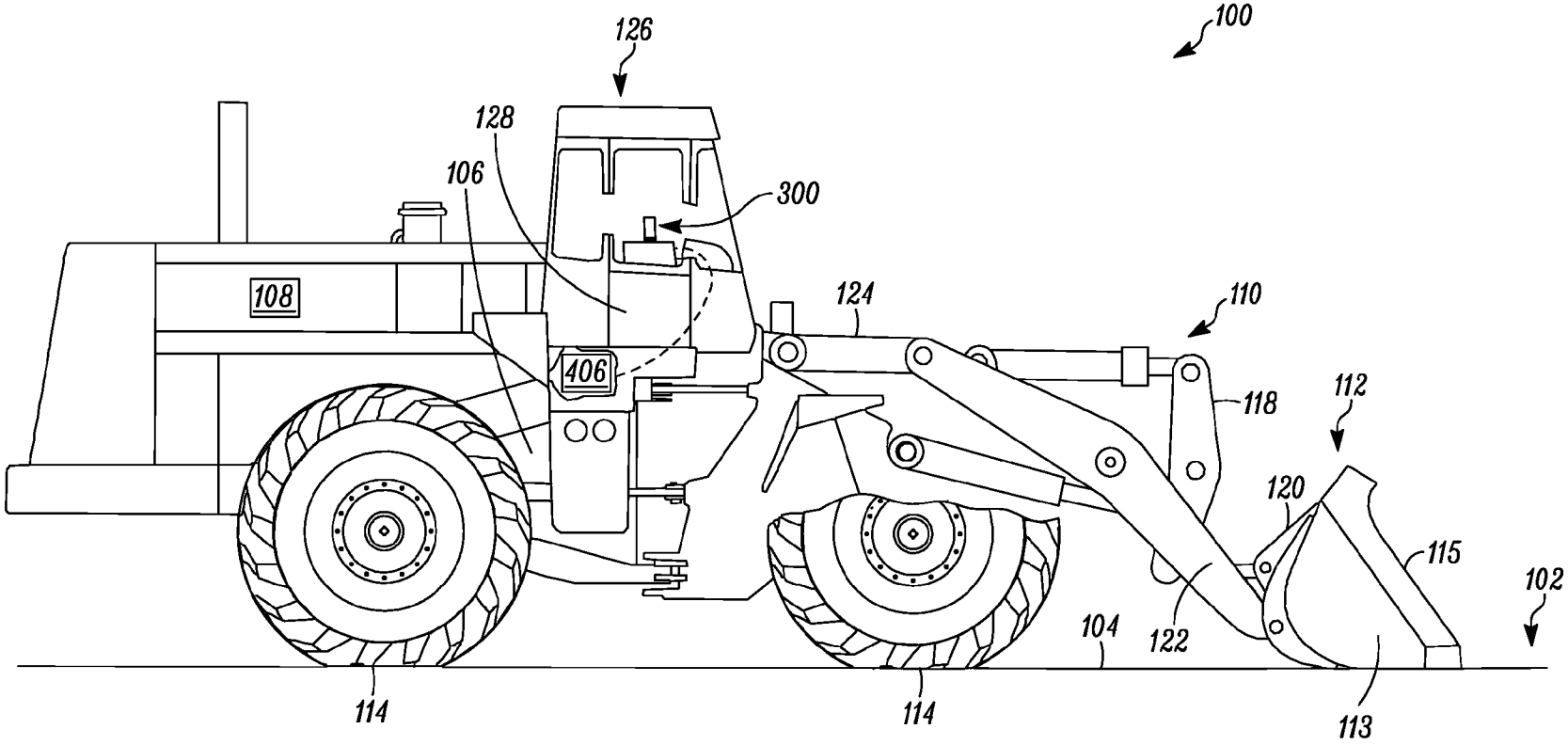
FIG. 4 is the exemplary machine of FIG. 1, showing a lowered and forwardly-open position (a ready-to-dig position) of the work implement, in accordance with an embodiment of the present disclosure.

Although each of the above-mentioned kick-out commands are explained in conjunction with FIGS. 2-4, it should be noted that the raise and lower kick-out commands are executed independently of the rack-back, dump, and/or ready-to-dig kick-out commands as the raise and lower kick-out commands are executed by movement of the hydraulic cylinder 122 while the rack-back, dump, and/or ready-to-dig kick-out commands are executed by movement of the hydraulic cylinder 124. To that end, it must be noted that the foregoing examples relating to the various kick-out commands in conjunction with FIGS. 2-4 should be regarded as being independent of each other. As such, FIG. 2 shows a raise kick-out and a rack-back kick-out implemented on the work implement 112 of the machine 100, FIG. 3 shows a raise kick-out and a dump kick-out implemented on the work implement 112 of the machine 100, and FIG. 4 shows a lower kick-out and a ready-to-dig kick-out implemented on the work implement 112 of the machine 100.

The pre-defined positions of the primary control 302 may include, e.g., extreme positions along axes AA' and BB'. For example, the primary control 302 may be moved to an extreme position located forward of axis CC' i.e., forwardly along axis AA' for moving the work implement 112 to the pre-defined lower kick-out position shown in FIG. 4. Similarly, in another example, the primary control 302 may be moved to an extreme position located rearward of axis CC' i.e., rearwardly along axis AA' for moving the work implement 112 to the pre-defined raise kick-out position shown in FIG. 2. In yet another example, the primary control 302 may be moved to an extreme position located leftward of axis CC' i.e., along axis BB' for tilting the work implement 112 upwardly to the pre-defined rack-back position shown in FIG. 2. Similarly, the primary control 302 may be moved to an extreme position located rightward of axis CC' i.e., along axis BB' for tilting the work implement 112 downwardly to the pre-defined dump kick-out position shown in FIG. 2. In various embodiments, it is also contemplated that the kick-out commands from the primary control 302 may be recognized and/or differentiated from user commands based inter alia upon factors such as speed of movement of the primary control 302 to a particular user commanded or user-defined kick-out position, a dwell time of the primary control 302 at the particular user commanded or user-defined kick-out position.

It should be noted that in various embodiments herein, the positions of the linkage 110 and the work implement 112 corresponding to each type of kick-out command can be pre-defined and stored at a memory device (not shown) associated with the controller 406. Some examples of memory devices may include, but is not limited to, read only memory (ROM), random access memory (RAM), floppy disks, compact disks, portable hard disks, and the like. Such devices may be contemplated for use with the controller 406 to execute functions that are consistent with the present disclosure.

Referring to FIGS. 5-6, the user controls 300 may further include a secondary control 304 mounted on the primary control 302. In an example, the secondary control 304 may be, e.g., a thumb-rocker switch as shown in FIGS. 5-6. In embodiments of this disclosure, the secondary control 304 may be configured to swivel, rightwardly or leftwardly, about axis CC'. Moreover, the secondary control 304 may be configured to be resiliently biased to a neutral position disposed in line with axis AA'. It has been contemplated that an operator of the machine 100 can optionally use the secondary control 304, in lieu of the primary control 302, for issuing user commands to actuate the hydraulic cylinder 124 for causing an upward tilting of the work implement 112 or a downward tilting of the work implement 112 relative to the lift arm 116. For example, the secondary control 304 could be configured such that a leftward swiveling of the secondary control 304 about axis CC' may cause an upward tilting/racking of the work implement 112 relative to the lift arm 116 while a rightward swiveling of the secondary control 304 about axis CC' may cause a downward tilting of the work implement 112 relative to the lift arm 116.

In embodiments of the present disclosure, it is also contemplated that the user controls 300 may further include at least one switch other than the secondary control 304. As shown in FIGS. 5-6, the user controls 300 further includes a pair of switches 306, 308. In the illustrated embodiment, each of the switches 306, 308 may be embodied as push button switches. However, in other embodiments, it can be contemplated by persons skilled in the art to include other types of switches such as, but not limited to, toggle switches, rocker switches, or rotary knobs in lieu of the push button switches. Preferably, the switches 306, 308, may be momentary switches that only require a brief activation by the operator to generate an operator signal for carrying out an automated work function.

In embodiments of the present disclosure, it is further contemplated that each of the switches 306, 308 is beneficially configured with at least one of the kick-out commands so as to implement at least one of the various pre-defined kick-out positions associated with the work implement 112. It will also be appreciated that in an embodiment, at least one of the switches 306, 308 can also be beneficially configured with more than one kick-out command so as to cause both the hydraulic cylinders 122, 124 of the machine 100 to execute movements of the work implement 112 corresponding to more than one type of pre-defined kick-out position, for example, the pre-defined raise kick-out position and the pre-defined dump kick-out position of the work implement 112 as shown in FIG. 3.

It will be further appreciated that when more than one kick-out command is associated with any of the switches 306, 308, movements corresponding to such kick-out commands may be carried out by the hydraulic cylinders 122, 124 simultaneously, tandemly, or with a phase shift between the individual movements, each of which can be contemplated for implementation by way of embodiments.

In an embodiment of this disclosure, it is contemplated that the switch 306 on the primary control 302 is incorporated with a ready-to-dig kick-out command. The switch 306 would therefore be operable to command a movement of the hydraulic cylinder 124 for causing a tilting of the work implement 112, upwardly or downwardly, to the pre-defined ready-to-dig position (forwardly facing position of the open side 115 as shown in FIG. 3. The aforesaid tilt movements being based on a current angular position of the work implement 112 relative to the lift arm 116.

Likewise, it is contemplated that the switch 308 on the primary control 302 be incorporated with the lower kick-out command. The switch 308 would therefore be operable to command a movement of the hydraulic cylinder 122 for lowering the work implement 112 to a pre-defined lower kick-out position e.g., to the pre-defined lower kick-out position shown in FIG. 4. In the foregoing embodiments, it is disclosed that the ready-to-dig kick-out command and the lower kick-out command are incorporated for implementation with switches 306 and 308. It should be noted that the ready-to-dig kick-out command and the lower kick-out command have been disclosed in conjunction with the switches 306, 308 respectively as it is envisioned that the ready-to-dig kick-out command and the lower kick-out command may be frequently required for use during an earth-moving operation of the machine 100. However, in other embodiments, it should be noted that any type of kick-out command can be incorporated for use with the switches 306, 308. Also, one skilled in the art will acknowledge that in other embodiments, additional switches may be provided in the user controls 300 for incorporation and implementation of other kick-outs besides the ready-to-dig kick-out command and the lower kick-out command implemented with the switches 306 and 308, respectively.

Figure 7:
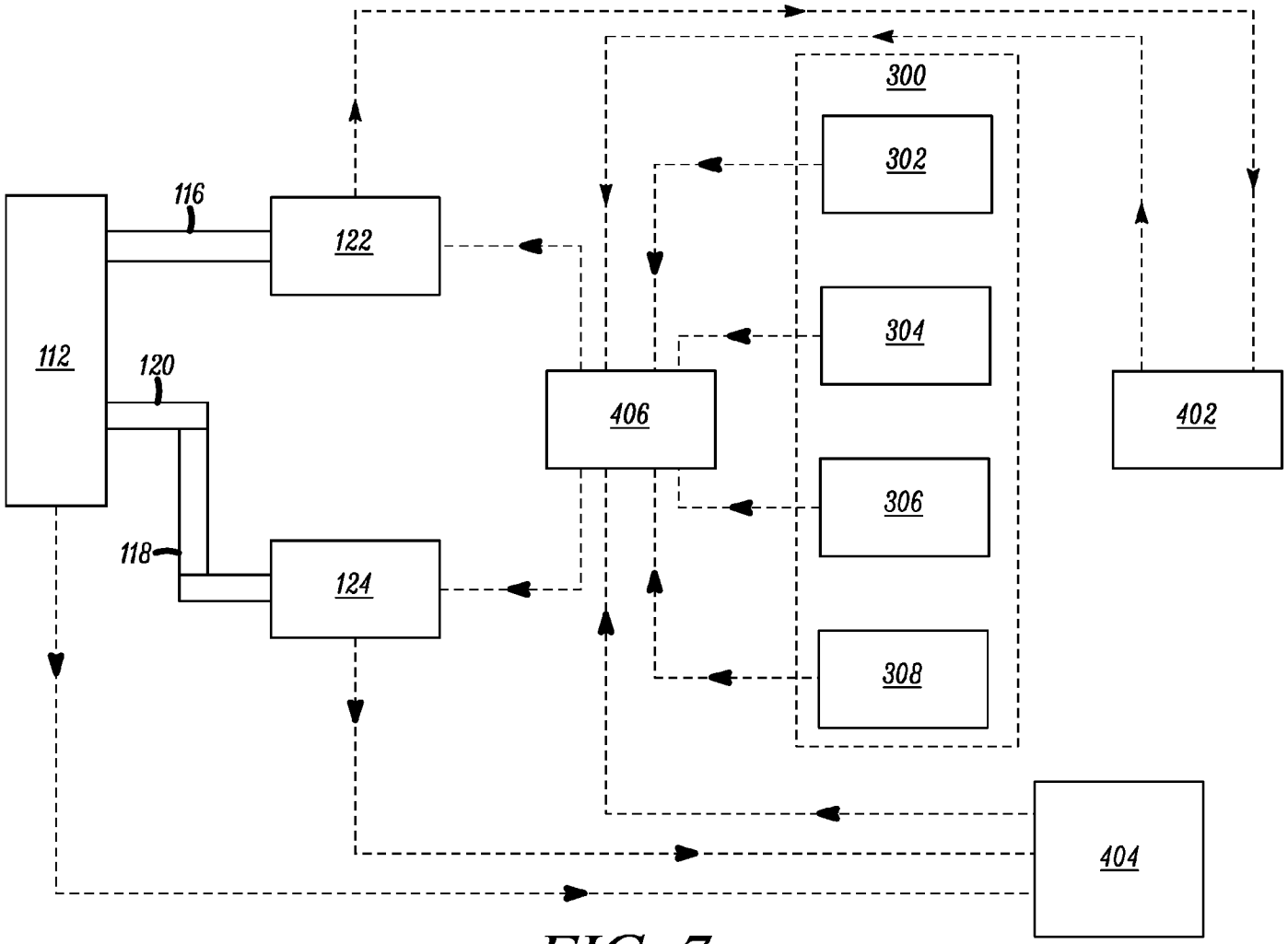
FIG. 7 is a schematic of a control system that can be employed in conjunction with the user controls of the machine of FIG. 1 for overriding accidental actuations of the user controls and preventing unintended operations of the work implement in accordance with embodiments of the present disclosure.

As shown in FIG. 7, a schematic of a control system 400 that can be employed in conjunction with the machine 100 is illustrated. It will be appreciated that the user controls 300 i.e., the primary control 302, the secondary control 304, the switch 306, and the switch 308 also form part of the control system 400.

The control system 400 also includes the controller 406 communicably coupled to each of the user controls 300 i.e., the primary control 302, the secondary control 304, the switch 306, and the switch 308. The controller 406 is configured to receive user commands from the primary control 302, and/or the secondary control 304.

Responsive to receiving a user command from the primary control 302 and/or the secondary control 304, the controller 406 moves the work implement 112 to a position defined by the user command from the primary control 302, the secondary control 304. Such user commands may be implemented by the controller 406 at the linkage 110 as a function of the movement of the primary control 302 relative to its neutral position i.e., axis CC', or the swiveling movement of the secondary control 304 relative to its neutral position disposed in line with axis AA' depending on which one of the user controls 300 i.e., the primary control 302 or the secondary control 304 is being operated.

The controller 406 is also configured to receive one or more kick-out commands from the user controls 300. Specifically, in an embodiment, the controller 406 may be configured to receive one or more kick-out commands from the primary control 302 and/or at least one the switches 306, 308. For example, the controller 406 may receive a lower kick-out command from the switch 308.

The control system 400 further includes a load sensor 402, and a position sensor 404 communicably coupled to the controller 406. The load sensor 402 is configured to generate load data indicative of a sensed load of the work implement 112. Some examples of the load sensors 402 may include, but is not limited to, strain gauges, load cells, or any other load measuring devices known to one skilled in the art. Therefore, it should be noted that a type of the load sensor 402 used is merely exemplary in nature and hence, non-limiting of this disclosure.

The position sensor 404 is configured to generate position data indicative of a sensed position of the work implement 112. Some examples of position sensors 404 may include, but is not limited to, hall-effect sensors, displacement sensors, proximity sensors, capacitive transducers or any other position measuring devices known to one skilled in the art. Therefore, it should be noted that a type of the position sensor 404 used is merely exemplary in nature and hence, non-limiting of this disclosure. Moreover, it should be noted that although one load sensor 402 and one position sensor 404 is depicted in the illustrated embodiment of FIG. 4, any number of the load sensor 402, and the position sensor 404 could be used to suit specific requirements of an application.

The controller 406 is further configured to receive the load data and position data of the work implement 112 from the load sensors 402, and the position sensor 404 respectively. Upon receipt of the load data of the work implement 112, the controller 406 determines a load state of the work implement 112 based on the received load data, and accepts or rejects the kick-out command based on at least the load state of the work implement 112.

In an exemplary embodiment, control data pertaining to a maximum value of load that can be carried by the work implement 112 may be provided before-hand to the controller 406. The controller 406 may compare the load state of the work implement 112 with such control data to ascertain if the work implement 112 is substantially loaded. In another exemplary embodiment, such control data may include control data corresponding to the various points in the range of movement of the work implement 112. In this embodiment, the controller 406 can also accept or reject the kick-out command based on both the load state of the work implement 112 and the position data obtained from the position sensor 404.

In an embodiment of this disclosure, the controller 406 is configured to reject the lower kick-out command if the load state of the work implement 112 indicates that the work implement 112 is substantially loaded. Regardless of whether the lower kick-out command has been issued from the primary control 302 or the switch 308, the controller 406 rejects any lower kick-out commands if the controller 406 determines that the work implement 112 is substantially loaded. In an exemplary embodiment, the controller 406 could compare the load state of the work implement 112 with the control data to ascertain if the sensed load of the work implement 112 has exceeded one or more pre-determined threshold values obtained from the control data. If so, the controller 406 could reject the lower kick-out command from either one of: the primary control 302 or the switch 308. This way, the controller 406 can prevent the work implement 112 from rapidly descending when substantially loaded, and inducing excessive and undesired oscillation in the machine 100.

The controller 406 could include various software and/or hardware components that are configured to perform functions consistent with the present disclosure. As such, the controller 406 of the present disclosure may be a stand-alone controller or may be configured to co-operate with an existing electronic control module (ECU) (not shown) of the machine 100. Further, the controller 406 may embody a single microprocessor or multiple microprocessors that include components for controlling movement of the work implement 112 based on the load state of the work implement 112 alone or in conjunction with the sensed position data of the work implement 112 received from the load sensor 402 and the position sensor 404. Numerous commercially available microprocessors can be configured to perform the functions of the controller 406. It should be appreciated that the controller 406 could readily be embodied in a general machine microprocessor capable of controlling numerous machine functions. The controller 406 may include a memory, a secondary storage device, a processor, and any other components for running an application. Various other circuits may be associated with the controller 406 such as power supply circuitry, signal conditioning circuitry, solenoid driver circuitry, and other types of circuitry. Various routines, algorithms, and/or programs can be programmed within the controller 406 for execution thereof to actuate a movement of the linkage 110 in relation to the frame 106 of the machine 100 based on the sensed load data alone or in conjunction with the sensed position data of the work implement 112 received from the load sensor 402 and the position sensor 404.

It may be noted that in various embodiments, the controller 406 could be further configured to interpret the movement of the primary control 302 to an extreme position, either as a kick-out command or not, based inter alia on factors such as, but not limited to, a speed of movement of the primary control 302 to the extreme position, a return speed of the primary control 302 back to neutral position i.e., axis CC', and/or a dwell time of the primary control 302 at the extreme position. One skilled in the art will acknowledge that various other factors associated with movement of the primary control 302 may be, additionally or optionally, incorporated by the controller 406 for determining if the primary control 302 has been moved to issue a kick-out command or not.

In another embodiment herein, the controller 406 may also be configured to reject the lower kick-out command if the work implement 112 is currently positioned in the downwardly open position. Regardless of whether the lower kick-out command has been issued from the primary control 302 or the switch 308, the position sensor 404 may indicate to the controller 406 that the work implement 112 is currently in a downwardly open position thereby facilitating the controller 406 to reject any lower kick-out commands while the work implement 112 remains in the downwardly open position. This way, the controller 406 can prevent the work implement 112 from slamming against the ground or a loading truck (not shown) given the downwardly open position of the work implement 112.

It is also contemplated by way of embodiments herein that the controller 406 is also configured to reject any lower kick-out commands from the switch 308 if the primary control 302 is not currently positioned in a neutral position i.e., when the primary control 302 is not positioned along axis CC' to which the primary control 302 is normally biased (refer to FIGS. 5-6). This way, the controller 406 eliminates a possibility of lowering the lift arm 116 and the work implement 112 to the pre-defined lower kick-out position relative to the frame 106 of the machine 100 if the primary control 302 currently remains positioned away from axis CC' pursuant to issuing other user commands such as raising, tilting-down, and racking-back the work implement 112. However, if the current position of the primary control 302 corresponds to a lowering command of the work implement 112, the controller 406 could allow the lower kick-out command based at least on the load state of the work implement 112, and the sensed position data of the work implement 112.

The controller 406 may also be configured to reject any kick-out commands associated with the switches 306, 308 if the kick-out command associated with such switches 306, 308 is contrary to a current operation being carried out by the work implement 112 under previously issued user commands from the primary control 302 or the secondary control 304. For example, if the primary control 302 is moved rearward of axis CC' to command a raising of the work implement 112 relative to the frame 106 and during such time if the switch 308 has been depressed for lowering the work implement 112 relative to the frame 106, then the controller 406 can reject the contradicting kick-out request arising from actuation of the switch 308. With such implementation, the controller 406 can be configured to beneficially interpret the actuation of the switches 306, 308 as an inadvertent actuation (one that could cause an unintended manner of operation for the machine 100) and hence, ignores the kick-out request from any of the switches 306, 308.

In a further embodiment, the controller 406 may be additionally configured to reject the lower kick-out command from the primary control 302 or the switch 308 if the secondary control 304 is not in a neutral position i.e., in line with axis CC'. If the secondary control 304 has been swiveled, rightwardly or leftwardly, about axis CC', then the controller 406 ignores any lower kick-out request issued from the primary control 302 or the switch 308. In a particular embodiment, by swiveling the secondary control 304 rightward of axis CC', the work implement 112 may be commanded to tilt downwardly relative to the lift arm 116. At this point, the controller 406 can reject any lower kick-out commands from the primary control 302 or the switch 308 and beneficially prevent the work implement 112 from descending rapidly and causing the front face of the work implement 112 to slam against a container of the truck or into the ground.

Also, in another particular embodiment, by swiveling the secondary control 304 leftward of axis CC', the work implement 112 may be commanded to tilt upwardly relative to the lift arm 116. Assuming that a user command has been issued from the primary control 302 for tilting the work implement 112 upwardly, and a lower-kick out command has been issued from the switch 308 to the controller 406; the controller 406 determines the load state of the work implement 112 from the sensed load data for ascertaining if the work implement 112 is substantially loaded. If so, the controller 406 can prevent the lower kick-out command from being implemented at the work implement 112.

In an exemplary embodiment, the controller 406 could compare the load state of the work implement 112 with the control data. In one embodiment, the control data could provide a single threshold load value (i.e., a stored value at a memory (not shown) of the controller 406 which are used for comparison with the sensed load to determine the load state of the work implement 112) that may be independent of position data of the work implement 112 received from the position sensor 404. Such a threshold value may be implemented within the controller 406 for comparing and determining if the load state of the work implement 112 exceeds the single threshold value and subsequently determining if the work implement 112 is substantially loaded or not.

It is hereby further contemplated that in other embodiments, the control data could provide multiple threshold load values that correspond to each position or a group of positions within the geometry of movement of the work implement 112. The multiple threshold load values may include multiple stored values at the memory of the controller 406 which are used for comparison with the sensed load data associated with corresponding positions or group of positions in the geometry of movement of the work implement 112 to determine the load states of the work implement 112 at such corresponding positions or group of positions in the geometry of movement of the work implement 112.

When the work implement 112 is operated to a given position and a kick-out command is issued, the controller 406 may determine if the load state of the work implement 112 exceeds the maximum limit of load for the work implement 112 at the pre-defined kick-out position. If so, the controller 406 rejects any lower kick-out commands issued from the switch 308 and can therefore, prevent the work implement 112 from descending rapidly and inducing excessive and undesired oscillations in the machine 100. However, if the controller 406 determines that the load state of the work implement 112 does not exceed a maximum limit of load from the control data for the work implement 112 at the pre-defined kick-out position, then the controller 406 can accept the lower kick-out command issued from the switch 308, and appropriately command movement of the lift arm 116 to the pre-defined lowered position.

In various embodiments of the present disclosure, it is further contemplated that the controller 406 can be further configured to reject kick-out commands from the switches 306, 308 if the kick-out commands at the switches 306, 308 have not been initiated and maintained in such initiation state for a minimum amount of time period. Such minimum amount of time period for which the kick-out commands at the switches 306, 308 should be maintained in the initiation state includes maintaining the initiation state without an interrupt for allowing the controller 406 to accept a kick-out request from any one or both of the switches 306, 308, more specifically, a lower kick-out request from the switch 308. The minimum amount of time period may lie in the order of a few milliseconds to a few seconds e.g., 100 milliseconds. Such implementation of incorporating a minimum amount of time period at the controller 406 for which the actuation of the switches 306, 308 must be maintained in the initiation state continuously without interruption could serve as a pre-requisite in the controller 406 for helping the controller 406 to ascertain if the kick-out/s commanded from actuation of the switches 306 and/or 308 are intentional or unintentional.

In various embodiments of this disclosure, it may be noted that the acceptance or rejection of kick-out commands is being explained in conjunction with the lower kick-out command in response to which the work implement 112 is lowered to a pre-defined lowered position set by the operator of the machine 100. However, a scope of the present disclosure should not be construed as being limited to the lower kick-out command alone. Rather a scope of the present disclosure can extend to implementation of the present controller 406 with capabilities for accepting or rejecting various other types of kick-out commands e.g., commonly known kick-outs including, but not limited to, raise kick-out, dump-kick-out, rack-back kick-out and the like while taking into account the criteria associated with the sensed load and position of the work implement 112.

INDUSTRIAL APPLICABILITY

The present disclosure may be applied to any machine that has a work implement to selectively disallow inadvertent or inappropriate kick-out commands. Some examples of such a machine may include shovels, diggers, hydraulic excavators, but is not limited thereto. Moreover, the present disclosure may be implemented for controlling a movement of other types of work implements typically associated with such machines.

Conventionally, a control in the movement of the work implement may have been accomplished on the basis of the position of the operating levers and on the previously executed movements of the machine. However, with use of various embodiments, the load condition of the work implement may be advantageously taken as an indicator, not merely of whether a kick-out command results from an accidental or deliberate activation of the user controls, but rather, of the appropriateness of the kick-out command in the particular use condition of the machine at the moment the kick-out command is received. Further advantageously, the step of accepting or rejecting the kick-out command may be accomplished based on sensor input indicating the present condition of the machine without reference to, for example, any stored history of previously executed operator commands or machine movements.

The principle of allowing or disallowing a kick-out based on the load condition of the work implement may thus be applied to mitigate the effects of inadvertent operation of the user controls, irrespective of whether the inadvertency is, for example, an accidental switch activation or a deliberate switch activation resulting from the inattention or inexperience of the machine operator, and irrespective of whether such inattention is reflected by the presence or absence of preceding operator commands that fall into an expected pattern or, on the contrary, reflects a momentary lapse in concentration. The principle thus applies equally in situations where operator commands follow an expected pattern, and in situations where operator commands diverge from an expected pattern to properly reflect the rapidly changing extraneous conditions of a work environment such as vehicle or pedestrian movements in the vicinity of the machine.

The principle of allowing or disallowing a kick-out based on the load condition of the work implement recognizes that whereas an inadvertent kick-out command may be countermanded by the operator, for example, by appropriately moving the joystick, a loaded work implement can result in unexpectedly rapid movement, which means that the contrary command must be given very quickly. However, the momentum of the loaded work implement may potentially cause some instability in the machine and also damage the hydraulic circuits of the machine if its motion is suddenly interrupted. This may occur, for example, during a lower kick-out, and may result in damage to the work implement if its momentum is sufficient to carry it beyond the pre-defined lowered position causing it to hit the ground.

In another example, if the kick-out command is a return-to-dig kick-out and the work implement is in the upwardly open position, the rapid movement of a loaded work implement to the forwardly open or return-to-dig position would be an unusual movement and hence unlikely to reflect the intention of the operator, and even if intentional, may nevertheless potentially stress the actuator and linkage when the movement of the work implement is arrested in the forwardly open position.

To mitigate these risks, as discussed above, the controller may be configured to reject the kick-out command where the work implement load state in combination with the work implement position and the direction of the kick-out may give rise to the potential for damage or instability of the machine if the kick-out were executed.

Figure 8:
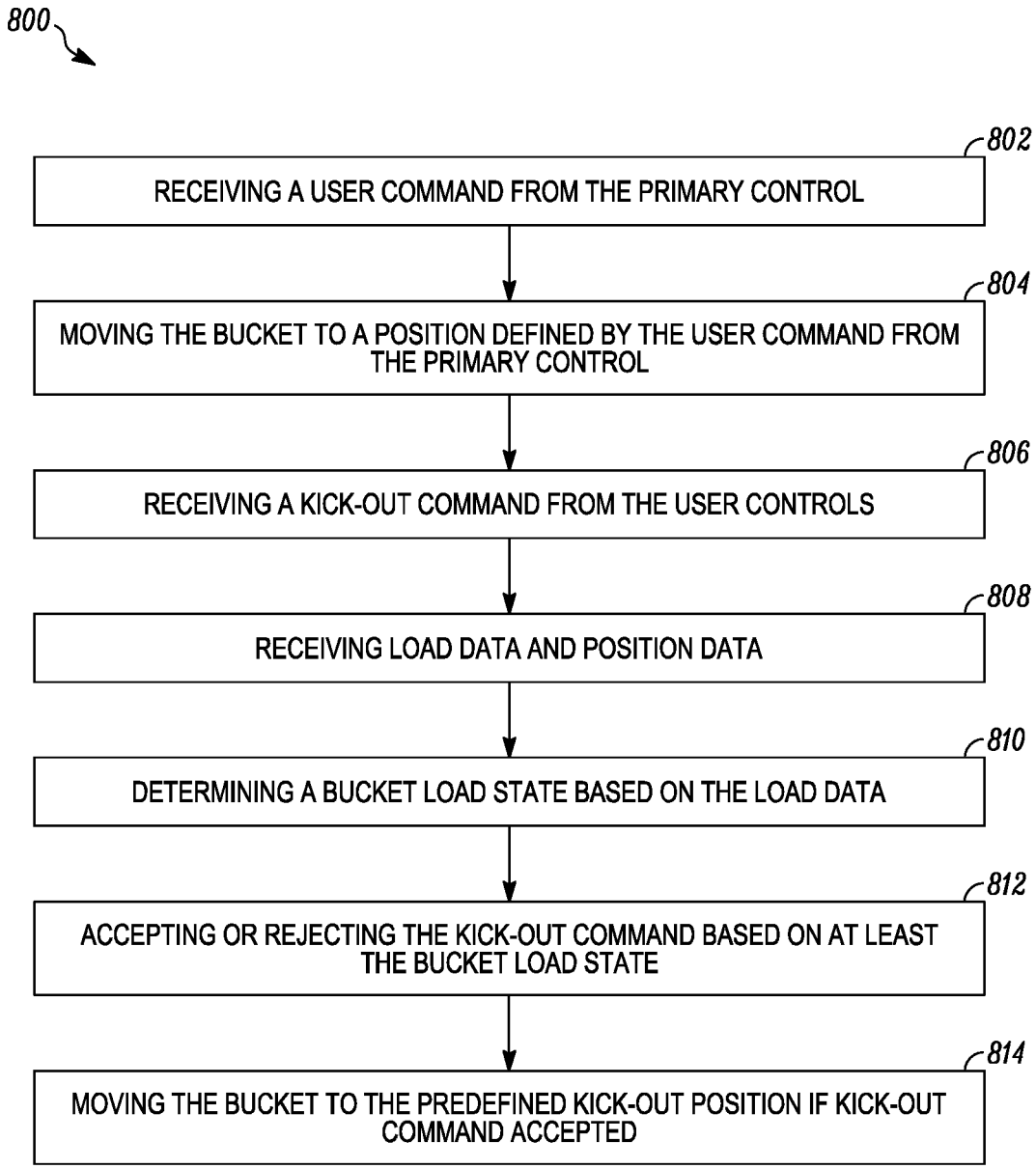
FIG. 8 is a flowchart depicting a method of controlling the machine of FIG. 1 in accordance with an embodiment of the present disclosure.

FIG. 8 is a flowchart illustrating a method 800 for controlling a machine e.g., the machine 100. The machine 100 includes the work implement 112 mounted on the linkage 110. The linkage 110 also includes hydraulic cylinder 122 connected to the lift arm 116 and the hydraulic cylinder 124 connected to the work implement link 120 via the lever link 118 and operable by the controller 406 to move the work implement 112 in a range of movement associated with the work implement 112. Moreover, the load sensor 402 and the position sensor 404 and the user controls 300 are communicably coupled to the controller 406. The load sensor 402 and the position sensors 404 are being configured to send a sensed load and position data of the work implement 112 to the controller 406 while the user controls 300 are operable for issuing user commands and kick-out commands to the controller 406.

Referring to FIG. 8, at block 802, the method 800 includes sending a user command from the primary control 302 e.g., the joystick, or from the secondary control 304 e.g., the thumb-rocker switch to the controller 406. The user command could include a command for raising, lowering, racking-back, or tilting-down the work implement 112 to a position defined by the user command. At block 804, the method 800 further includes moving the work implement 112 to a position defined by the user command from the primary control 302 or the secondary control 304. Depending on a manner of movement of the primary control 302 i.e., rightward, leftward, forward, or rearward of axis CC', or a manner of swivelling movement, leftward or rightward of axis CC', of the secondary control 304 by the operator; the controller 406 can actuate a movement of the linkage 110 and command a movement of the work implement 112 to a position defined by the user command from the primary control 302 or the secondary control 304.

At block 806, the method 800 further includes receiving a kick-out command from the user controls 300 i.e., the primary control 302, the switch 306, and/or the switch 308. It has been contemplated that the kick-out commands from the primary control 302 may be recognized and/or differentiated from the user commands based inter alia upon factors such as speed of movement of the primary control 302 to a particular user commanded or user-defined kick-out position, a dwell time of the primary control 302 at the particular user commanded or user-defined kick-out position.

Therefore, as disclosed earlier herein, the primary control 302 could be moved to pre-defined kick-out positions e.g., extreme positions along each of the axes AA' and BB' to provide the corresponding kick-out pre-defined to the controller 406. Moreover, the kick-out command being incorporated with the switch 306 could preferably include the ready-to-dig kick-out. Similarly, the kick-out command being associated with the switch 308 could preferably include a lower kick-out for lowering the lift arm 116 and causing a subsequent movement of the work implement 112 to the pre-defined lowered position. The switches 306, 308 can therefore, be operated to issue a ready-to-dig kick-out or a lower kick-out command to the controller 406.

At block 808, the method 800 further includes receiving load data and position data of the work implement 112 by the controller 406. The load sensor 402, and the position sensor 404 are configured to generate and transmit load data and position data associated with the work implement 112 to the controller 406. At block 810, the method 800 includes determining, by the controller 406, a load state of the work implement 112 on the basis of at least the sensed load data.

At block 812, the method 800 further includes accepting or rejecting the kick-out command received by the controller 406 on the basis of at least load state of the work implement 112. For example, if the controller 406 determines that the current load state of the work implement 112 is greater than the maximum limit prescribed by the control data known to the controller 406, the controller 406 can reject any of the kick-out requests, more specifically a lower-kick-out request that may be issued from the primary control 302 or the switch 308, and thereafter the method 800 terminates. However, if the controller 406 determines that the load state of the work implement 112 is less than the maximum limit prescribed by the control data, the controller 406 accepts the kick-out commands and the method 800 proceeds to block 814 where the controller 406 moves the work implement 112 to the pre-defined kick-out position e.g., a ready-to-dig position corresponding to an actuation of the switch 306 or a lower kick-out position corresponding to an actuation of the switch 308.

It will be understood that embodiments may be implemented in wheel loaders and other machines which allow the operator to initiate a kick-out function, whether via a primary control or alternatively or additionally via a separate kick-out control, preferably a switch such as a button. In the latter case, by allowing or disallowing a kick-out based on at least the load condition of the work implement, the disadvantageous consequences of accidental operation of the additional kick-out control may be substantially mitigated. Therefore, it will be appreciated that with implementation of many embodiments, a maximum production of the machine 100 can be maintained through rapid movements of the linkage 110 while the control system 400 of the present disclosure helps to prevent inadvertent or accidental operations of the machine 100.

Although embodiments of the present disclosure are explained in conjunction with a WL having a work implement, other types of machines such as, but not limited to, shovels, diggers, hydraulic excavators, and the like can be optionally used to implement the embodiments herein. Moreover, embodiments of the present disclosure can also be implemented with other types of work implements typically associated with various types of earth moving machines known in the art. For example, if the machine 100 were embodied in the form of a hydraulic excavator having an excavating work implement, then a ready-to-dig function could be implemented by a rearwardly facing position of the excavating work implement in lieu of the forwardly open position of the work implement 112 disclosed in conjunction with the WL herein. Various other modifications may be contemplated by persons skilled in the art and such modifications are considered to fall within the scope of the appended claims.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A control system for a machine having a linkage, a work implement mounted on the linkage, and an actuator, the actuator being connected to the linkage and controlled using the control system to move the linkage and the work implement, the control system comprising:

a plurality of sensors configured to generate load data indicative of a sensed load of the work implement and position data indicative of a sensed position of the work implement;

user controls for sending user commands and a kick-out command, the user controls including at least one primary control, the primary control being configured to send at least the user commands; and a controller communicably coupled to the plurality of sensors and to the user controls and configured to:

receive the user commands and the kick-out command from the user controls, receive the load data and the position data from the plurality of sensors, responsive to receiving the user commands from the primary control, move the work implement to a position defined by the user commands from the primary control, responsive to the kick-out command from the user controls, move the work implement to a predefined kick-out position, determine a work implement load state based on the load data, and accept or reject the kick-out command based on at least the work implement load state.

2. The control system of claim 1, wherein the kick-out command comprises a lower kick-out command to lower the work implement to a predefined lowered position, and the controller is further configured to reject the lower kick-out command if the work implement load state indicates that the work implement is substantially loaded.

3. The control system of claim 2, wherein the work implement is pivotable between an upwardly open position and a downwardly open position, and the controller is further configured to reject the lower kick-out command if the work implement is in the downwardly open position.

4. The control system of claim 1, wherein the controller is further configured to accept or reject the kick-out command based on at least the work implement load state and the position data.

5. The control system of claim 1, wherein the work implement is pivotable to define an angular position of the work implement in a range of movement between an upwardly open position and a downwardly open position, and the controller is further configured to accept or reject the kick-out command based on at least the work implement load state and the position data indicating the sensed angular position of the work implement.

6. A method of controlling a machine having a controller, a work implement mounted on a linkage, an actuator connected to the linkage and operable using the controller to move the work implement, a plurality of sensors, and user controls for sending user commands and a kick-out command to the controller, the user controls including at least one primary control for sending at least the user commands, the controller being communicably coupled to the sensors and to the user controls, the method comprising:

sending, to the controller from the plurality of sensors, load data indicative of a sensed load of the work implement and position data indicative of a sensed position of the work implement;

sending, from the primary control to the controller, the user commands;

responsive to the user commands from the primary control, operating, using the controller, the actuator to move the work implement to a position defined by the user commands from the primary control;

sending, from the user controls to the controller, the kick-out command;

determining, using the controller, a work implement load state based on the load data;

accepting or rejecting, using the controller, the kick-out command from the user controls, based on at least the work implement load state; and responsive to accepting, using the controller, the kick-out command from the user controls, operating, using the controller, the actuator to move the work implement to a predefined kick-out position.

7. The method of claim 6, wherein the kick-out command comprises a lower kick-out command to lower the work implement to a predefined lowered position, and further comprising rejecting, using the controller, the lower kick-out command if the work implement load state indicates that the work implement is substantially loaded.

8. The method of claim 6, wherein the work implement is pivotable between an upwardly open position and a downwardly open position, and further comprising rejecting, using the controller, the lower kick-out command if the work implement is in the downwardly open position.

* * * * *